US006188026B1

(12) United States Patent
Cope et al.

(10) Patent No.: US 6,188,026 B1
(45) Date of Patent: Feb. 13, 2001

(54) PRE-LUBRICATED CABLE AND METHOD OF MANUFACTURE

(75) Inventors: Kyle Cope, Columbia, SC (US); Tareq Haque, Hinsdale, MA (US)

(73) Assignee: Pirelli Cable Corporation, Lexington, SC (US)

( * ) Notice: Under 35 U.S.C. 154(b), the term of this patent shall be extended for 0 days.

(21) Appl. No.: 09/057,803

(22) Filed: Apr. 9, 1998

(51) Int. Cl.[7] ..... H01B 7/00

(52) U.S. Cl. ..... 174/120 R; 174/120 C; 174/120 FP

(58) Field of Search ..... 174/120 C, 120 R, 174/120 SR, 110 SR, 36, 113 R, 110 R

(56) References Cited

U.S. PATENT DOCUMENTS

| | | | | |
|---|---|---|---|---|
| 3,565,213 | | 2/1971 | Heller | 184/15 |
| 3,925,216 | | 12/1975 | Moorhouse | 252/49.3 |
| 4,063,617 | | 12/1977 | Shenk | 184/15 R |
| 4,164,617 | * | 8/1979 | Van Kesteren | 174/23 |
| 4,170,673 | | 10/1979 | Conti | 427/401 |
| 4,189,545 | * | 2/1980 | Modic | 521/131 |
| 4,265,801 | * | 5/1981 | Moody et al. | 260/40 R |
| 4,356,139 | | 10/1982 | Rowland et al. | 264/174 |
| 4,360,492 | | 11/1982 | Rowland et al. | 264/40.1 |
| 4,446,279 | * | 5/1984 | Keogh | 525/106 |
| 4,461,712 | | 7/1984 | Jonnes | 252/49.3 |
| 4,489,029 | * | 12/1984 | Keogh et al. | 264/174 |
| 4,522,733 | | 6/1985 | Jonnes | 252/49.3 |
| 4,617,338 | * | 10/1986 | Keogh et al. | 524/437 |
| 4,673,516 | | 6/1987 | Berry . | |
| 4,684,214 | * | 8/1987 | Goldmann et al. | 350/96.23 |
| 4,781,847 | | 11/1988 | Weitz | 252/49.3 |
| 5,077,370 | * | 12/1991 | Lee | 528/26 |
| 5,227,080 | | 7/1993 | Berry . | |
| 5,543,189 | * | 8/1996 | Nakakura et al. | 428/36.8 |

OTHER PUBLICATIONS

OSi Specialties, Inc., "LE–323 Silicone Emulsion", 1996, Feb.

OSi Specialties, Inc., "Silicone Emulsion ALE–75", 1995, Aug.

* cited by examiner

*Primary Examiner*—Kristine Kincaid
*Assistant Examiner*—William H Mayo, III
(74) *Attorney, Agent, or Firm*—L. P. Brooks; Norris, McLauglin & Marcus

(57) ABSTRACT

An energy transmission cable is provided with a lubricating coating layer upon its outer covering, such as an outer jacket or outer insulation of the cable, is permanent on the outer covering, provides for a coefficient of friction between the cable and a cable engaging surface that is less than the coefficient of friction between the cable without the lubricating coating layer and the engaging surface and which has an outer surface which is dry, non-tacky and water insoluble. The features of the lubricating coating layer remain substantially unaffected upon exposure to the environmental and physical conditions associated with storage and installation of an energy cable.

20 Claims, 1 Drawing Sheet

PRE-LUBRICATED CABLE AND METHOD OF MANUFACTURE

FIELD OF THE INVENTION

The present invention relates to cables that are installed in ducts, conduits, trays or other passageways, and more particularly, to a lubricating coating layer that is provided on an outer jacket or an outer insulation of a cable to facilitate handling of the cable during storage and during and after installation of the cable in ducts, conduits, trays or other passageways.

BACKGROUND

Energy transmission cables, such as electrical power cables and communication data transmission cables, are typically constructed with a substantially circular cross-section and include a solid insulating jacketing or sheath which encloses the internal components of the cable. The shape and composition of the outer surface of the sheath of the cable determines the ease with which the cable can be pushed or pulled across and in contact with another surface, such as, for example, the outer surface of the outer jacket of another cable or the inner wall surface of a passageway in which the cable is installed. Frequently, a cable is installed in a passageway, such as a duct, which contains other cables, such as optical fiber cables or electrical power cables.

The friction between a cable and another surface which the cable contacts resists movement of the cable and subjects the cable, or its internal components, to stress as the cable is moved with respect to the surface. The amount of stress that is imposed on the cable increases as the length of the cable that is subjected to friction increases. The stress on the cable generated by friction can cause damage or harm to the components of the cable. For example, if too large of a pulling force is applied to a cable during installation as a result of friction that occurs along a long length of the cable that is pulled over another surface, the cable may elongate beyond an allowable extent. This undue elongation can cause breaks or fractures in the cable that severely damage the cable jacket and internal components of the cable.

It is known to apply a lubricant to the jacket of a cable at the point and time that the cable is to be installed in a duct, or to apply a lubricant to the innermost surface of the duct in which the cable is to be installed, such as by flooding of lubricants into the duct, to reduce the friction between the respective surfaces of the cable and the duct that will contact each other during cable installation. See, for example, U.S. Pat. Nos. 3,565,213 and 4,063,617, incorporated by reference herein, which describe methods of lubricating a cable as the cable is pulled into a duct. Improper or inadequate lubrication of either the cable or the duct can result in damage to the cable when the cable is pulled against the innermost surface of the duct during or after installation at an installation site.

The application of a lubricant on a cable or a duct in which the cable is to be installed, at the time of installation, is not, however, always a simple, inexpensive and convenient procedure. For example, the environmental conditions present at the installation site may be severe. Also, the additional manpower and equipment required to apply the lubricant may be costly. Further, the entire lubricating procedure can be very time consuming.

Currently, many of the known lubricants that are applied to a cable at an installation site are made of grease, oil or gel-like material, each of which can cause a messy, heavy residue of lubricant to remain on the cable jacket. This messy residue can impede subsequent handling, and operations to obtain access to internal components of the cable, such as splicing of an optical fiber cable to access individual fibers in the cable.

U.S. Pat. No. 3,925,216, incorporated by reference herein, attempts to solve the problems that a residue on the cable jacket can cause by disclosing a lubricant which will evaporate after installation. The lubricant of the '216 patent, however, is an alcohol water solution and it is known that alcohol may potentially have an adverse effect on typical cable jacket materials, such as polyethylene and polypropylene. Additionally, it has been found that the lubricant of the '216 patent evaporates quickly, thereby requiring its application near or at the installation site, which may be inconvenient and time consuming. Further, the lubricant of the '216 patent is water soluble and, therefore, may become removed from or washed off of the cable jacket if a cable with such lubricant is installed in a duct where water has collected or collects. Consequently, over time, the lubricant that was applied to the jacket to ease the pulling of the cable may be absent from the jacket when the need for maneuvering the cable within or removing the cable from a duct arises.

U.S. Pat. No. 4,170,673, incorporated by reference herein, discloses a gel-like, semi-liquid lubricant for a cable which does not evaporate. This lubricant, however, may be messy to apply and use and, in addition, is removable with a water flush. Thus, like the lubricant of the '216 patent, if the cable has been installed in a duct in which water collects or flows, the cable subsequently may not be easily removed from or maneuvered within the duct.

U.S. Pat. Nos. 4,522,733 and 4,461,712, incorporated by reference herein, disclose substantially neutral aqueous lubricants which can be applied to cables that are to be installed in water-filled conduits. These lubricants are slow to evaporate and leave a residue on evaporation which can provide substantial lubricating properties for a substantial time after the cable is installed in a water-filled duct. These lubricants, however, are not permanent and may wear off of a cable, even before the residue itself evaporates, if the cable experiences heavy loading when it is pulled through a duct or across another cable. Further, these lubricants are most effective when still in an aqueous gel, which results in the disadvantages discussed above.

U.S. Pat. No. 4,781,847, incorporated by reference herein, discloses a lubricant which is slow to evaporate and provides effective dry lubrication, thereby appearing to solve most of the foregoing problems related to the lubricant which is applied to a cable. It has been found, however, that the lubricant of the '847 patent is not permanent and may become removed from or wear off of the jacket as a result of heavy loading on the cable during cable pulls.

Therefore, there is a need for a lubricating coating layer for a jacket of a cable which is easily provided on the cable jacket during the cable manufacturing process; is dry, non-tacky and water insoluble once a lubricant composition, from which the lubricating coating layer is formed, is applied and dried and cured on the cable; does not provide a messy residue on the cable; maintains a high degree of lubricity at the cable jacket surface for a long time after being provided on the cable, including the time subsequent to installation of the cable in a passageway; is a permanent coating which can withstand the wear associated with abrasive loadings ordinarily experienced by a cable; is nonflammable; and continues to have the above qualities after being subjected to a wide range of temperatures and to conditions of moisture.

SUMMARY OF THE INVENTION

In accordance with the present invention, a lubricating coating layer is provided on an outer covering of an energy transmission cable, such as an outer jacket or an outer insulation of the cable, before the cable is shipped to the customer and preferably, during manufacture of the cable on a manufacturing line, or at least prior to handling of the cable after it is manufactured except for the layer, to provide the cable with a substantially permanent coating layer on the outer covering which has an outer surface which is dry and non-tacky and to reduce the coefficients of static and kinetic friction between the cable and a typical metal or plastic surface against which the cable is moved. Preferably, after drying and curing of a lubricant composition from which the layer is formed on the cable, the layer is substantially insoluble in water. The lubricating coating layer features are maintained even when the cable is exposed to the physical environments and the handling conditions typically incident to storage following manufacture and occurring during and after installation at an installation site.

The lubricating coating layer on the cable of the present invention is formed from a lubricant composition consisting essentially of a release agent based in a water carrier. The water carrier comprises at least about 85% to about 99.9% by weight of the composition and the release agent is less than about 15% by weight of the composition. The release agent can be an organo polysiloxane, an organo siloxane polymer or a polyalkylsiloxane with grafted polyether functionalities and, preferably, is formulated from a mixture of polydimethylsiloxane, organic emulsifiers and biocides.

In preferred embodiments, the lubricating coating layer reduces the coefficients of static and kinetic friction between the cable and the typical surface against which the cable is moved by at least about 20%, and preferably by more than about 40%, in comparison to the coefficients of friction between such surface and the same cable which does not include the lubricating coating layer on its outer covering as determined using the ASTM D 1984 test procedure adapted for the testing of cable friction.

In a further preferred embodiment, the outer surface of the lubricating coating layer, which is the outermost surface of the lubricated cable, remains dry and non-tacky on the outer covering, remains on the cable and provides friction reducing properties even after the cable is subjected to variations in temperature over a wide range, preferably between about −60° C. and about 200° C., and to conditions of moisture.

In another preferred embodiment, the lubricating coating layer is adhered to the cable outer covering with sufficient adhesive strength to provide that the coating layer remains adhered to the outer covering even after the cable is exposed to conditions of high moisture and a wide range of temperatures and conditions of ordinary abrasive action, such as the abrasion caused by moving the cable against another cable or surface. In a further preferred embodiment, the lubricating coating layer remains adhered to the cable outer covering almost indefinitely, unless the layer is cleaned with a solvent or abraded more rigorously than what is the normal practice during installation of the cable and maneuvering of the cable after installation.

In another preferred embodiment, the lubricating coating layer is nonflammable and does not generate a significant amount of smoke when subjected to a flame.

In a further preferred embodiment, the lubricating coating layer is devoid of halogen content.

In a further aspect of the invention, the lubricant composition from which the lubricating coating layer is formed is applied to the outer covering of a cable and dried and cured thereon as the cable is manufactured on a cable manufacturing line. The lubricant composition can be applied uniformly to the outer covering to form a uniform layer by an aerosol spray, nozzle spray, tank and drip system, passage through a bath of the lubricant composition or a sponge wipe. Drying and curing of the composition on the outer covering of the cable can comprise an air dry, a hot air wipe or processing in an oven chamber.

In an alternative embodiment, drying and curing of the lubricant composition on the outer covering can occur at room temperature.

DETAILED DESCRIPTION OF PREFERRED EMBODIMENTS

Figure 1:
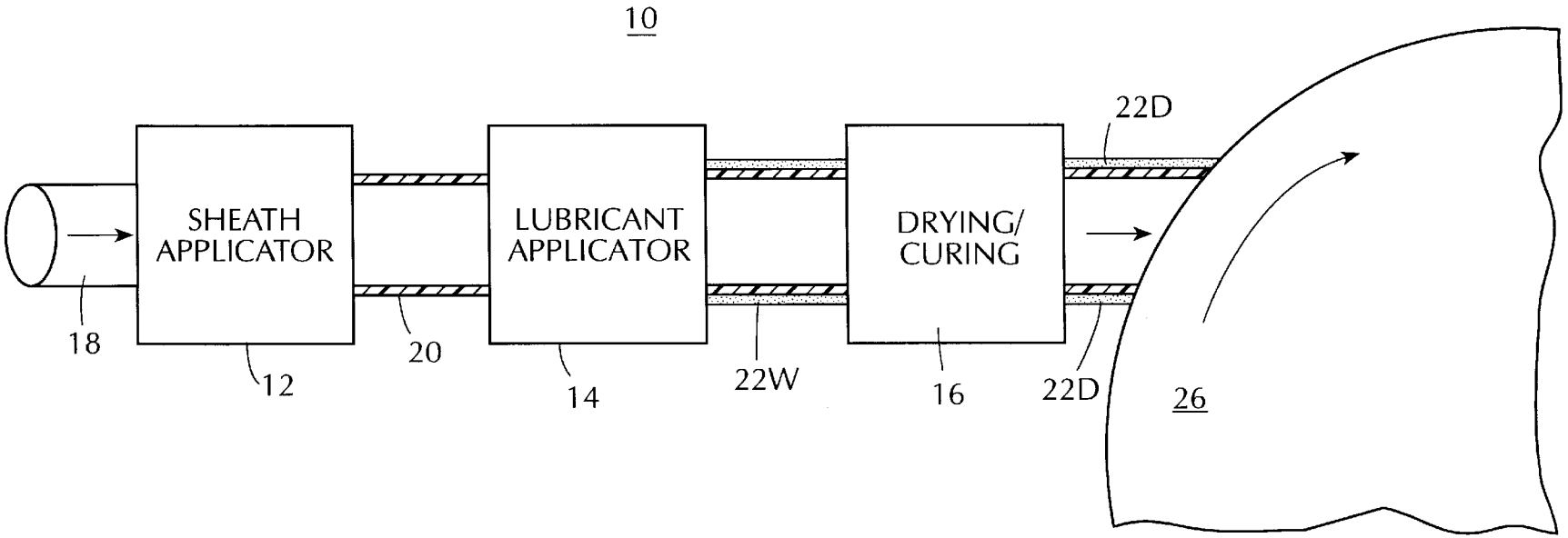
FIG. 1 is a cable manufacturing line for providing a lubricating coating layer on an outer jacket of a cable in accordance with the present invention.

The present invention will be described in connection with an electrical supply cable having a lubricating coating layer on its polymeric outer jacket and the application of a composition from which the lubricating coating layer is formed to the jacket of the cable during cable manufacture. It is to be understood that the cable on which the lubricating coating layer is provided during cable manufacture can be any type of energy transmission cable, such as an optical fiber cable, a cable containing one or more electrical conductors or a cable containing both optical and electrical transmission media, and that the lubricating coating layer can be provided on the outer covering, such as the outer jacket or outer insulation, of such cables.

In accordance with the present invention, a lubricating coating layer, which is applied to a jacket of an electrical voltage supply cable during manufacture of the cable as described in detail below, is formed from a lubricant composition consisting essentially of about 85% to about 99.9% by weight water carrier and about 15% to about 0.1% by weight release agent. The release agent, preferably, consists essentially of an organo polysiloxane or a polyalkylsiloxane with grafted polyether functionalities, and, most preferably, an organic siloxane polymer with an organic emulsifier or in suspension. In an alternative embodiment, the release agent can include other additives, such as, for example, a biocide to resist degradation of the lubricating coating layer from air or bacteria, but preferably, the other additive is not a halogen containing additive.

LE-323, which is commercially available from OSI Specialties Inc. of Greenwich. Conn., has been found to be a suitable release agent for a preferred embodiment of the invention. LE-323 is a hydroxy-terminated polydimethysiloxane having about 35% silicone content with an anionic emulsifier. LE-323 is identified by OSI Specialities Inc. as a fine silicone emulsion (35 percent by weight) of an extremely high viscosity polydimethylsiloxane fluid and as having an oil phase of extremely high molecular weight with a viscosity on the order of 300,000 cP. The main lubricant in LE-323 is provided by the silicone content. LE-323 also has a high molecular weight, which enhances its durability as a lubricant on the cable jacket or outer insulation. In a preferred embodiment, the composition of the present invention is made from a mixture of LE-323 and water, where preferably the water content is greater than about 90% of the mixture by weight.

ALE-75, which is commercially available from OSI Specialties Inc. of Greenwich, Conn., has also been found to be a suitable release agent for a preferred embodiment of the invention. ALE-75 is an aminoalkyl organomodified polydimethysiloxane having about 60% silicone content with an nonionic emulsifier. ALE-75 has a low molecular weight, which enhances its adherence to the outer jacket or outer insulation of the cable. The amino functionality group in ALE-75 provides for secondary hydrogen bonds within the lubricant and between the lubricant and the outer jacket or outer insulation of the cable, which also enhances the durability of the lubricant. Like LE-323, the main lubricant in ALE-75 is provided by the silicone content. In a preferred embodiment, the coating composition of the present invention is made from a mixture of ALE-75 and water, where preferably, the water content is greater than about 90% of the mixture by weight.

In an alternative embodiment, the release agent may be formed from a mixture of LE-323 and ALE-75 in any concentration to take advantage of the respective durability and adhering properties of the two compositions. The resultant release agent is mixed with water to form a coating composition, where preferably, the water content is greater than about 90% of the mixture by weight of the resultant coating composition.

AQUALIFT W-3133, which is commercially available from Franklyn Industries, has also been found to be a suitable coating composition for a preferred embodiment of the invention. AQUALIFT W-3133 is an emulsion with silicone content in a water carrier. Preferably, the water carrier content is at least about 85% of the formulation and the release agent is less than about 15% of the formulation. Experimentation has found that when AQUALIFT W-3133 is applied to the jacket of a cable, at least about 85% of the AQUALIFT W-3133 is cured on the jacket of the cable after the water carrier has evaporated and a residue remains on the jacket which is non-tacky and dry and becomes a permanent layer on the cable jacket. In a preferred embodiment, AQUALIFT W-3133, in its cured and dried form on the jacket of the cable, has a radial thickness of about 0.001 inch or less, and becomes about 85% cured in about 10 seconds at about 140° F. or in about 24 hours at room temperature. LE-323 and ALE-75 have similar drying times.

Lubricant compositions including LE-323, ACE-75 and AQUALIFT W-3133, respectively, were applied to the insulating outer jacket of a low voltage 750 KCM energy cable operating at voltages between about 0 V and about 600 V, where the jacket is an EVA base formulation. Preferably, the cable jacket includes an insulating material comprised of from about 50% to about 100% by weight hydrated mineral filler and an elastomeric or plastomeric composition based on compounds whose main ingredient is EVA and which are devoid of halogens, sulfur and nitrogen. The hydrated mineral filler comprises from about 30% to about 80% by weight of the jacket and the elastomeric or plastomeric composition comprises from about 70% to about 20% by weight of the jacket. When each of the foregoing compositions were applied to the jacket of such an electrical cable, it was found that the coefficients of static and kinetic friction between the jacket of the cable and a typical surface against which the cable is to be pulled were reduced by about 35% to about 65%, in comparison to the coefficients of friction between the cable without such coating composition on the jacket thereof and the typical surface against which the cable is pulled. The typical surface against which a cable is moved can comprise a metal surface, such as the aluminum surface of a tray, a cotton-braided insulating outer jacket of a cable or a plastic surface, such as PVC, polyethylene, chlorosulfonated polyethylene or a highly filled EVA, or any other suitable jacket material. The friction reducing properties provided by the lubricating coating layer remained substantially unaffected when the cable was exposed to extreme cold and heat, high humidity, submersion in water and abrasion by being pulled against other energized cables which did not have the coating layer properties on their jackets.

The cables with the foregoing compositions applied to their jackets, respectively, were tested with a modified ASTM D 1894 test set-up adapted to test cables exposed to various environmental and aging conditions. ASTM D 1894 is a known test procedure typically utilized for measuring the coefficients of friction for a thin film. The experimentation included pulling a one foot portion of the electrical cable having the lubricating coating layer thereon for a distance of 20 inches and at a rate of 20 inches/min. along a substrate having the same composition as the jacket of the electrical cable under test. The coefficients of friction of the lubricated cables in relation to an unlubricated cable surface were initially determined at room temperature and then the lubricated cables were tested at room temperature conditions for determining the coefficients of friction between the lubricated cables and the test surfaces after the cables were subjected to various environmental and aging conditions.

Tables 1–3 illustrate the results of the experimentation. It was found that the three preferred coating compositions discussed above significantly reduce the coefficients of static and kinetic friction (COF) as measured between the cable and the jacket surface of the cable without lubrication and against which the cable was moved when the lubricated cables were exposed to cold temperatures of about −35° C. for four hours, 95% humidity at a temperature of about 100° F. for three days, submersion in room temperature tap water for about one hour, exposure to a temperature of about 121° C. for seven days and scraping against a metal surface (abrasion).

TABLE 1

| Testing | LE-323 | | | |
|---|---|---|---|---|
| | COF Without Lubricant | | COF With Lubricant (% Change) | |
| Conditions | $\mu_S$ | $\mu_K$ | $\mu_S$ | $\mu_K$ |
| Cold(−35° C./4 hr) | 1.070 | .949 | 0.392(63.4) | 0.404(57.4) |
| Humidity (95% @ 100° F./3 Days) | 1.790 | 1.229 | 0.668(62.7) | 0.711(37.3) |
| Moisture (23° C. Water/1 hr) | 1.323 | 1.296 | 0.667(49.6) | 0.819(36.8) |
| Aging (121° C./7 Days) | 1.231 | 1.287 | 0.518(57.9) | 0.525(59.2) |
| Abrasion | 1.257 | 1.354 | 0.722(42.6) | 0.658(51.4) |

TABLE 2

| Testing | ALE-75 | | | |
|---|---|---|---|---|
| | COF Without Lubricant | | COF With Lubricant (% Change) | |
| Conditions | $\mu_S$ | $\mu_K$ | $\mu_S$ | $\mu_K$ |
| Cold(−35° C./4 hr) | 1.125 | 1.253 | 0.614(45.4) | 0.592(52.8) |
| Humidity (95% @ 100° F./3 Days) | 1.137 | 1.053 | 0.632(44.4) | 0.498(52.7) |
| Moisture (23° C. Water/1 hr) | 1.182 | 1.188 | 0.802(32.2) | 0.721(39.3) |
| Aging (121° C./7 Days) | 1.451 | 1.552 | 0.616(57.5) | 0.579(62.7) |
| Abrasion | 1.513 | 1.555 | 0.840(44.5) | 0.588(62.42) |

TABLE 3

| Testing | AQUALIFT W-3133 | | | |
|---|---|---|---|---|
| | COF Without Lubricant | | COF With Lubricant (% Change) | |
| Conditions | $\mu_S$ | $\mu_K$ | $\mu_S$ | $\mu_K$ |
| None | 1.10 | 1.25 | 0.73(34) | 0.70(44) |
| Cold(−35° C./4 hr) | 0.95 | 1.10 | 0.55(42) | 0.70(36) |
| Humidity (95% @ 100° F./3 Days) | 1.21 | 1.27 | 0.69(43) | 0.69(46) |
| Moisture (23° C. Water/1 hr) | 1.15 | 1.25 | 0.71(38) | 0.79(37) |
| Aging (121° C./7 Days) | 0.96 | 1.02 | 0.57(41) | 0.60(41) |
| Abrasion | 1.27 | 1.33 | 0.69(46) | 0.69(45) |

It is to be understood that results on cables having a polymeric jacket other than the jacket described above may differ but that the coefficients of friction between the cable with the lubricating coating layer and the other surface would similarly be reduced in comparison with the coefficients of friction between the unlubricated cable and the other surface.

It has also been found that the coefficients of static and kinetic friction between the cable with a lubricating coating layer formed from AQUALIFT W-3133 and an aluminum plate are reduced by about 42% or more in comparison with the coefficients of friction between the unlubricated cable and the aluminum plate. Aluminum is a common material found in trays through which optical fiber cables are routed.

Also, it was found that when a fifteen inch cable specimen was scraped three times over a sharp metal edge at room temperature, such that at least about a 25 N normal force was applied to the cable at the scraping point, the desired features of the lubricating coating layer remained substantially unchanged.

In addition, it was found that when a lubricated cable segment was pulled over a cable substrate which was heated to temperatures between about 83° C. and about 88° C., which simulates the temperatures at the jacket of a cable which is energized, the coefficients of friction between the lubricated cable segment and the cable substrate were similarly reduced.

Preferably, a cable having the lubricating coating layer and subjected to temperatures ranging from −60° C. to 200° C. will continue to provide the friction reducing properties and also remain water insoluble, non-tacky, dry and adhered to the jacket. Dry as used in the present invention is defined as containing a substantially insignificant amount of liquid or water, especially in comparison to the liquid content of materials such as oil, gel or grease. Non-tacky as used in the present invention is defined in terms of the sensation felt by a human hand when the hand is touched to a surface having zero or substantially no moisture thereon and as the phenomenon that upon contact between a first surface and a second surface which is non-tacky, i.e., the surface with the lubricating coating layer thereon, there is no residual material remaining on the non-tacky surface from the first surface, whatever the first surface may be, after the first and second surfaces are separated from each other and there is no resistance to prevent separation of the first and second surfaces after they contact each other.

Most preferably, the lubricating coating layer remains adhered to the jacket, is water insoluble, non-tacky and dry and reduces the coefficients of friction at the cable outermost surface with respect to an engaging surface when the cable is exposed to: (i) a cold temperature environment in which temperatures are frequently reach −50° C., which is about the temperature at which optical fiber cables are rated to perform unaffected; and (ii) to emergency operating temperatures reaching 140° C., which is about the temperature that a medium or high voltage cable, which operates between voltages of about 2 KV to about 69 KV and about 69 KV to about 230 KV, respectively, can reach when such cables are energized.

Additionally, the foregoing compositions are advantageous in that they are nonflammable and do not generate a significant amount of smoke when subjected to a flame, such that they will not adversely affect any flammability or smoke requirements of the cable. Also, the coating made from these compositions remains on the cable jacket almost indefinitely, without affecting any safety standards of the cable. The coating is also preferably devoid of halogen content.

FIG. 1 illustrates an exemplary cable manufacturing line 10 for applying to the outer surface of the outermost jacket of a cable the composition from which the lubricating coating layer of the present invention is formed. It is to be understood that the composition from which the lubricating coating layer of the present invention is formed on a cable also can be applied to an outer insulation of a cable on the line 10 in accordance with the present invention. Lubrication of the jacket of a cable on the line 10 is preferred because a durable, uniform coating layer having the desired properties described above can be obtained on the jacket of the cable efficiently, economically and with relative ease. Thus, the need to lubricate and the difficulties associated with lubricating at an installation site are eliminated.

Referring to FIG. 1, the line 10 includes, in consecutive series, a sheath applicator 12, a lubricant applicator 14, a drying and curing device 16 and a cable storage device 26. The sheath applicator 12 is suitably an extruder which extrudes thermosetting plastic material, such as polyethylene or a thermosetting plastic, over a cable core which is provided to the applicator 12. The sheath applicator 12 includes a drying means, such as a cooling trough (not shown), which cools the plastic material applied to the core.

The lubricant applicator 14 can include an aerosol spray, a nozzle spray, a tank and drip system, a through bath or a sponge wipe.

The drying and curing device 16, which follows the lubricant applicator 14 on the line 10, can include an air drying means, a hot air wipe means or a heated chamber and, preferably, is a five meter long heated metal tube.

The cable storage device 26 is a conventional take-up reel or a drum.

In operation, a core 18 of energy transmission components, which is otherwise completely manufactured, is provided to the sheath applicator 12. The sheath applicator 12 applies, preferably by extrusion, a polymerized plastic coating composition to the core 18. The plastic coating composition cools to become a jacket 20 on the core 18. The jacket 20 can be made of plastic or other common insulating materials used in electrical or optical cables.

The core 18 with the jacket 20 passes through the lubricant applicator 14, which applies the inventive composition on the jacket 20 to form a lubricating coating layer thereon. As the core 18 leaves the applicator 14, a coating layer 22W is on the jacket 20. The layer 22W is the inventive lubricating composition in its uncured and undried form, and is wet and not non-tacky to the touch because the water component of the composition has not yet been dried and cured.

The core 18 then passes through the drying and curing device 16. The device 16 dries and cures the coating layer 22W by applying heat thereto. Preferably, the layer 22W is placed for about ten seconds in a chamber which has been heated to about 140° F. The device 16 evaporates the water carrier portion of the coating composition to leave a dry, non-tacky lubricating coating layer 22D on the cable jacket 20 when the core 18 emerges from the drying and curing device 16. The dry, non-tacky lubricating layer 22D is, thus, the end product obtained after drying and curing of the layer 22W.

The core 18 with the jacket 20 and the layer 22D on the jacket 20 is then supplied to the storage means 26, such as a take-up reel. The dried and cured layer 22D can undergo further processing, such as application of ink or paint markings thereto, before take-up on the reel 26. In normal operation, the line speed of a cable manufacturing line is not decreased by application of the lubricating composition from which the lubricating coating layer is formed on the jacket of the cable and the drying and curing thereof.

In an alternative embodiment, the line 10 does not include the device 16 and the layer 22W is dried and cured for a sufficient time, such as for about 24 hours, at room temperature to obtain the dry, non-tacky layer 22D. Although the coating layer 22W can be dried at room temperature, the application of heat to dry the lubricating coating layer promotes improved bonding between the lubricating coating layer and the cable jacket.

In a preferred embodiment, the energy transmission cable on which the lubricating coating layer is provided is an electrical power cable, an optical fiber cable or an electro-optical hybrid cable, each including a core of energy conductors and possibly including intermediate layers of insulation or armoring, all of which are disposed within the jacket 20.

Although preferred embodiments of the present invention have been described and illustrated, it will be apparent to those skilled in the art that various modifications may be made without departing from the principles of the invention.

What is claimed is:

1. An energy transmission cable having an outer covering encircling a core containing an energy transmission medium, wherein the outer covering includes an outer surface, wherein the improvement comprises:

a dry, non-tacky, lubricating coating layer adhering to the outer surface of the covering and having an outer surface which forms the outer surface of the cable, wherein the layer is a discrete and independent layer of a lubricating release agent which can be applied on the covering in a water carrier and which adheres to the outer surface of the covering and wherein the outer surface of the covering without the layer has a coefficient of friction with respect to an engaging surface and wherein the outer surface of the layer has a coefficient of friction with respect to the engaging surface which is at least about 20% less than the coefficient of friction of the outer surface of the covering without the layer with respect to the engaging surface.

2. The cable of claim 1, wherein the outer covering is an outer jacket.

3. The cable of claim 2, wherein the outer jacket is a plastic material.

4. The cable of claim 3, wherein the plastic material is one of polyvinylchloride, polyethylene and chlorosulfonated polyethylene.

5. The cable of claim 1, wherein the outer covering is an outer insulation.

6. The cable of claim 1, wherein the lubricating coating layer, after exposure to temperatures between about −60° C. and about 200° C., remains substantially dry, substantially non-tacky and adhered to the outer surface of the covering and has the coefficient of friction at the outer surface thereof with respect to the engaging surface which is at least about 20% less than the coefficient of friction of the outer surface of the covering without the layer with respect to the engaging surface.

7. The cable of claim 6, wherein the lubricating coating layer is substantially water insoluble.

8. The cable of claim 1, wherein the core includes a conductor for carrying medium or high electrical voltages and wherein the lubricating coating layer remains substantially dry, substantially non-tacky and adhered to the outer surface of the covering and has the coefficient of friction at the outer surface thereof with respect to the engaging surface which is at least about 20% less than the coefficient of friction of the outer surface of the covering without the layer with respect to the engaging surface upon exposure of the cable to temperatures between about −40° C. and about 140° C.

9. The cable of claim 1, wherein the core includes an optical energy conductor for carrying optical signals and wherein the lubricating coating layer remains substantially dry, substantially non-tacky and adhered to the outer surface of the covering and has the coefficient of friction at the outer surface thereof with respect to the engaging surface which is at least about 20% less than the coefficient of friction of the outer surface of the covering without the layer with respect to the engaging surface upon exposure of the cable to temperatures between about −50° C. and about 70° C.

10. The cable of claim 1, wherein the lubricating coating layer is of an organo polysiloxane release agent.

11. The cable of claim 10, wherein the organo polysiloxane is a polyalkylsiloxane.

12. The cable of claim 1, wherein the release agent is an organo polysiloxane release agent included in a lubricating coating composition consisting essentially of the organo polysiloxane release agent in the water carrier, wherein the water carrier is about 80% to about 99.9% by weight of the composition and the release agent is less than about 15% by weight of the composition.

13. The cable of claim 1, wherein the lubricating coating layer has a radial thickness which does not exceed 0.001 inches.

14. The cable of claim 1, wherein the lubricating coating layer, after exposure to a condition of moisture, remains substantially dry, substantially non-tacky and adhered to the outer surface of the outer covering and has the coefficient of friction at the outer surface thereof with respect to the engaging surface which is at least about 20% less than the coefficient of friction of the outer surface of the outer covering without the layer with respect to the engaging surface.

15. The cable of claim 14, wherein the exposure of the lubricating coating layer to the condition of moisture is submerging the cable with the lubricating coating layer in tap water which is at room temperature for one hour.

16. The cable of claim 1, wherein the composition of the lubricating coating layer is a mixture of a first and a second organo polysiloxane polymer.

17. The cable of claim 16, wherein the first and second organo polysiloxane polymers have respective molecular weights and wherein the molecular weight of the first organo polysiloxane polymer is substantially greater than the molecular weight of the second organo polysiloxane polymer.

18. An energy transmission cable having an outer covering encircling a core containing an energy transmission medium, wherein the outer covering includes an outer surface, wherein the improvement comprises:

a dry, non-tacky, lubricating coating layer adhering to the outer surface of the covering and having an outer surface which forms the outer surface of the cable, wherein the layer is a discrete and independent layer of a lubricating release agent which can be applied on the covering in a water carrier and which adheres to the outer surface of the covering and wherein the outer surface of the covering without the layer has a coefficient of friction with respect to a metal engaging surface and wherein the outer surface of the layer has a coefficient of friction with respect to the metal engaging surface which is at least about 20% less than the coefficient of friction of the outer surface of the covering without the layer with respect to the metal engaging surface.

19. An energy transmission cable having an outer covering encircling a core containing an energy transmission medium, wherein the outer covering includes an outer surface, wherein the improvement comprises:

a dry, non-tacky, lubricating coating layer adhering to the outer surface of the covering and having an outer surface which forms the outer surface of the cable, wherein the layer is a discrete and independent layer of a lubricating release agent which can be applied on the covering in a water carrier and which adheres to the outer surface of the covering and wherein the outer surface of the covering without the layer has a coefficient of friction with respect to an engaging surface of a plastic material and wherein the outer surface of the layer has a coefficient of friction with respect to the engaging surface which is at least about 20% less than the coefficient of friction of the outer surface of the covering without the layer with respect to the engaging surface.

20. The cable of claim 19, wherein the plastic material is one of polyvinylchloride, polyethylene and chlorosulfonated polyethylene.

* * * * *

UNITED STATES PATENT AND TRADEMARK OFFICE

CERTIFICATE OF CORRECTION

PATENT NO. : 6,188,026 B1
DATED : February 13, 2001
INVENTOR(S) : Cope et al.

It is certified that error appears in the above-identified patent and that said Letters Patent is hereby corrected as shown below:

ABSTRACT,
Line 3, after the comma (,), insert -- The lubricating coating layer --;

Column 5,
Line 36, after the comma (,) insert -- ACE-75 is identified by OSI Specialties Inc. as a non-ionic, 60 percent active, oil-in-water silicone emulsion containing an emulsion polymerized aminofunctional silicone polymer and dimethy-silicone --.

Column 10,
Line 62, cancel "composition of".

Signed and Sealed this

Twenty-fifth Day of December, 2001

*Attest:*

*Attesting Officer*

JAMES E. ROGAN
*Director of the United States Patent and Trademark Office*